US007381091B2

(12) United States Patent
Menez

(10) Patent No.: US 7,381,091 B2
(45) Date of Patent: Jun. 3, 2008

(54) ELECTRIC CONNECTOR HOUSING WITH IMPROVED CONTACT STOPS AND ELECTRIC CONNECTOR COMPRISING SAID HOUSING

(75) Inventor: Frederic Menez, Hermeray (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/515,097

(22) Filed: Sep. 1, 2006

(65) Prior Publication Data

US 2007/0066135 A1 Mar. 22, 2007

Related U.S. Application Data

(63) Continuation of application No. PCT/EP2005/002322, filed on Mar. 4, 2005.

(30) Foreign Application Priority Data

Mar. 4, 2004 (FR) ..... 04 02287

(51) Int. Cl.
*H01R 13/40* (2006.01)

(52) U.S. Cl. ..... 439/595; 439/752; 439/386

(58) Field of Classification Search ..... 439/296, 439/386, 595, 752

See application file for complete search history.

(56) References Cited

U.S. PATENT DOCUMENTS

| | | | | |
|---|---|---|---|---|
| 3,648,213 | A | 3/1972 | Kobler | 339/59 R |
| 4,664,460 | A * | 5/1987 | Vandame | 439/595 |
| 5,857,876 | A * | 1/1999 | Hatagishi | 439/752 |
| 6,152,768 | A * | 11/2000 | Beugnot et al. | 439/595 |
| 2002/0052153 | A1 * | 5/2002 | Takatsuki et al. | 439/752 |
| 2007/0066135 | A1 * | 3/2007 | Menez | 439/595 |

FOREIGN PATENT DOCUMENTS

DE 38 33 196 A1 4/1990

* cited by examiner

*Primary Examiner*—James Harvey
(74) *Attorney, Agent, or Firm*—Harrington & Smith, PC

(57) ABSTRACT

This housing includes an assembly of sockets each provided to receive a contact by engaging along a (Z) axis, wherein each socket of the assembly is essentially defined by at least two opposite axial lateral walls and includes two elastic locking latches extending in an essentially axial manner from two respective opposite transverse walls. At least one bar acting as a limiting stop with regard to the insertion of the contact in the socket is provided on the front end of each socket, said bar being formed in such a way that the axial projection thereof is located between the latches and does not interfere therewith.

10 Claims, 3 Drawing Sheets

Figure 1:
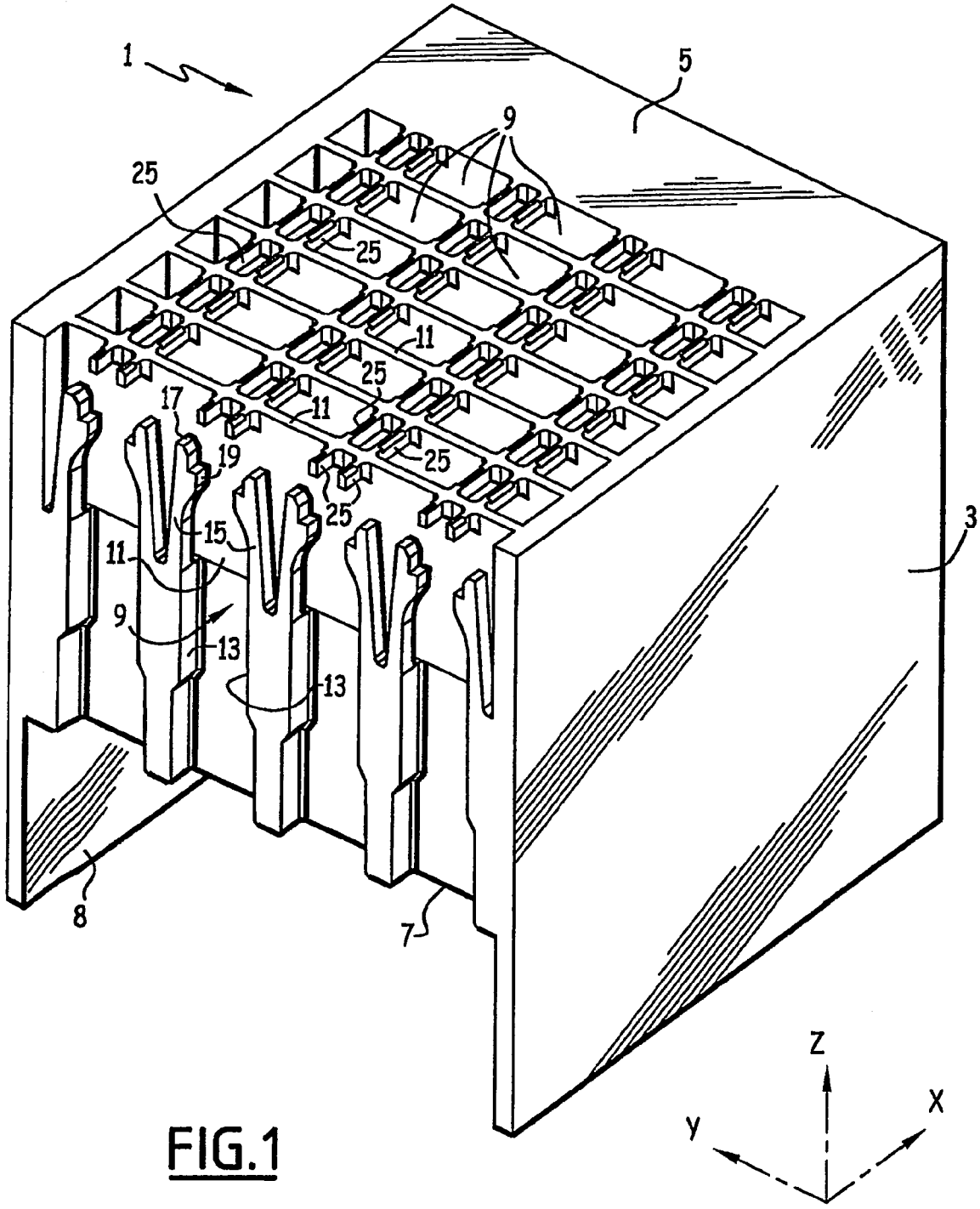

ELECTRIC CONNECTOR HOUSING WITH IMPROVED CONTACT STOPS AND ELECTRIC CONNECTOR COMPRISING SAID HOUSING

CROSS REFERENCE TO RELATED APPLICATION

This application is a continuation of International Patent Application No. PCT/EP2005/002322 filed Mar. 4, 2005.

The present invention concerns an electric connector housing, which comprises an assembly of sockets, each provided to receive a contact by engagement along an axis, each socket of the assembly being essentially defined by at least two opposite lateral walls, and comprising two elastic locking latches extending in an essentially axial manner from two respective opposite transverse walls.

In such a housing, each contact, after being positioned in the socket provided for this purpose, is locked in place inside this socket by means of the latches that oppose its removal. On the other hand, stops are formed in front of each socket in order to limit the insertion of the contact.

In the prior art, these stops constitute blocks made of the same material as the housing, and formed at the four corners of the front end section of the socket, defining a narrowing thereof.

Generally, the housings or housing parts of the above type are made by molding one piece, and the interior forms of the sockets are obtained by pins fitted in the molds and generally movable along their axis inside the mold during the molding operation.

With this molding technique, which renders it impossible to obtain undercut forms with regard to the socket axis, the maximal width of the latch is limited by the transverse distance separating two stop blocks.

Thus, the use of current molding techniques to create connector housings of known structure severely limits the dimensions of the locking latches, and consequently the maximum retention force in the socket produced by the latches on the corresponding contact.

Other more complex molding techniques, implementing mobile slides, permit obtaining undercut forms. Nevertheless, these techniques are not only difficult to apply to the manufacture of connector housings of this type, due to the thinness of the wall of the sockets, but are also very detrimental from the point of view of tooling costs.

The object of the invention is to design a connector housing of the type described above, whose structure permits increasing the retention force exerted by the latches, and which can be obtained by the simplest usual molding techniques.

For this purpose, in an electric connector housing according to the invention, each socket comprises, on its front end side, at least one bar forming a stop limiting the insertion of the contact in the socket, which is formed so that its axial projection is situated between the latches and does not interfere with them.

According to other optional characteristics of the invention:

- said bar connects the two opposite lateral walls adjacent to the transverse walls;
- each socket of the assembly is provided with two such bars forming stops, these bars extending in parallel;
- on at least one axial section, at least one of the two latches has a width roughly equal to the width of the socket;
- at least one of the two latches is connected to the respective transverse wall by its rear end, comprises a hook piece which projects towards the axis of the socket from its front end side which is free, and has a maximum width on the side of its rear end;
- each socket of the assembly is symmetrical with regard to an axial plane extending between the two latches; and
- the housing is molded of one plastic piece.

The invention also pertains to an electric connector comprising a housing such as previously described, and contacts engaged in the respective sockets of said housing.

Figure 2:
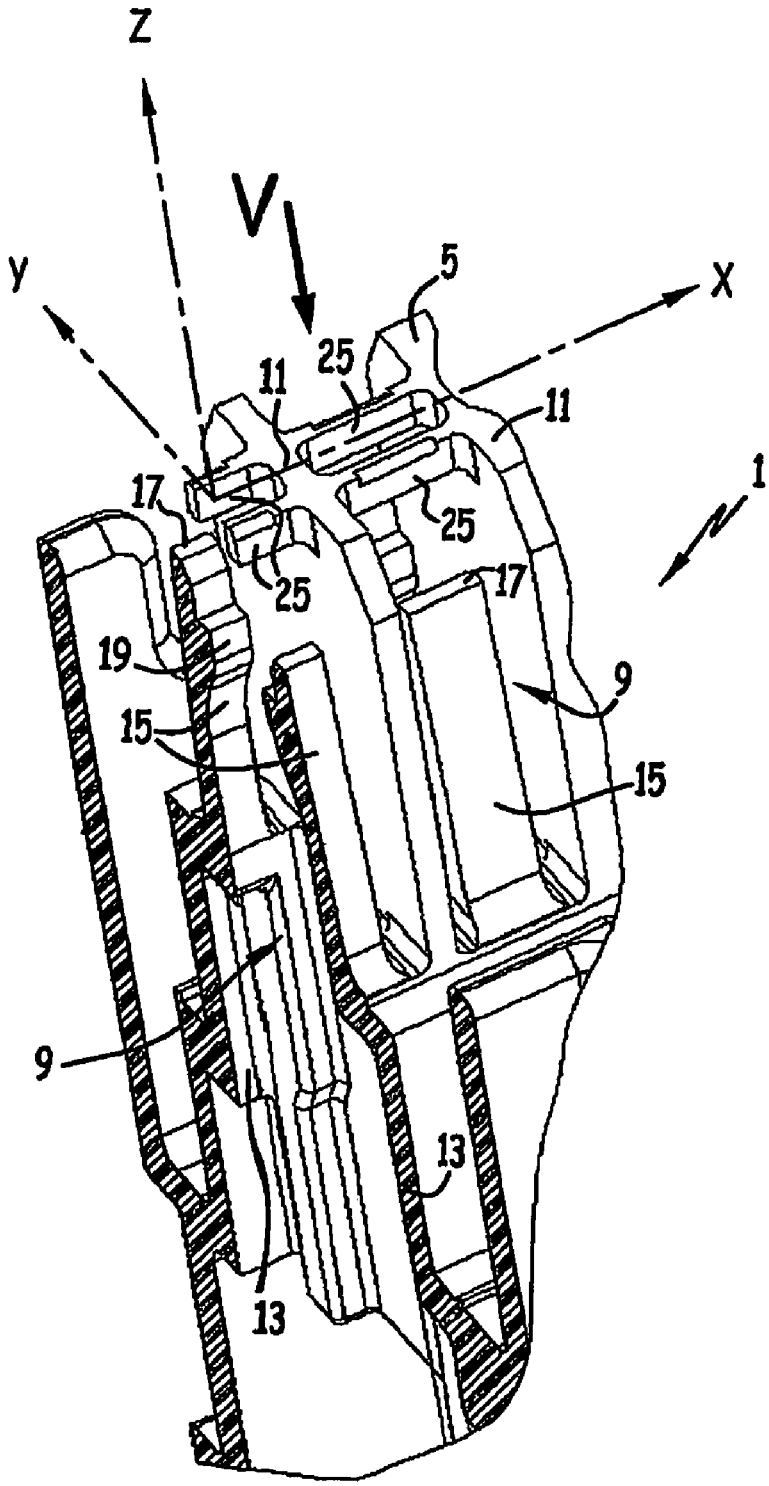
Figure 3:
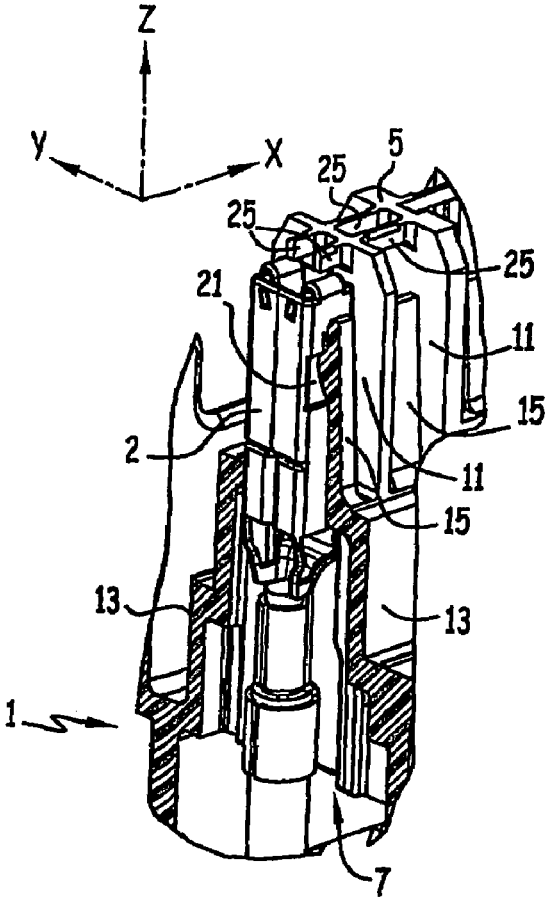
Figure 4:
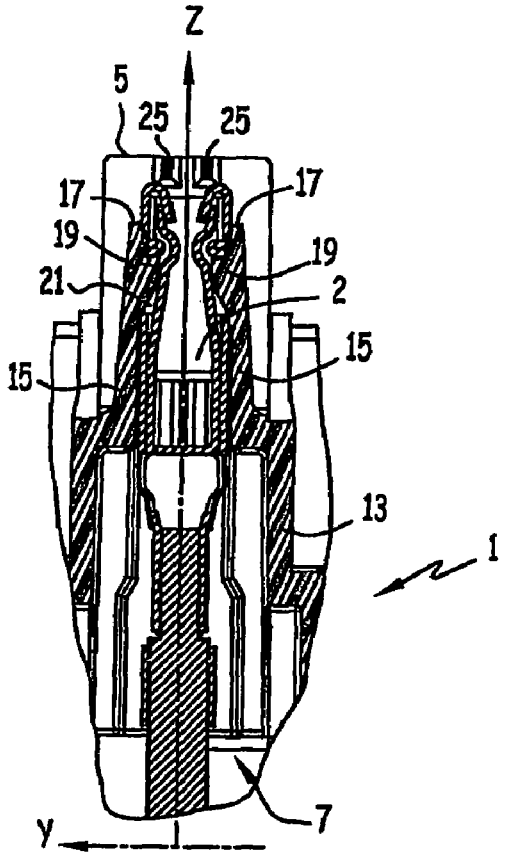
Figure 5:
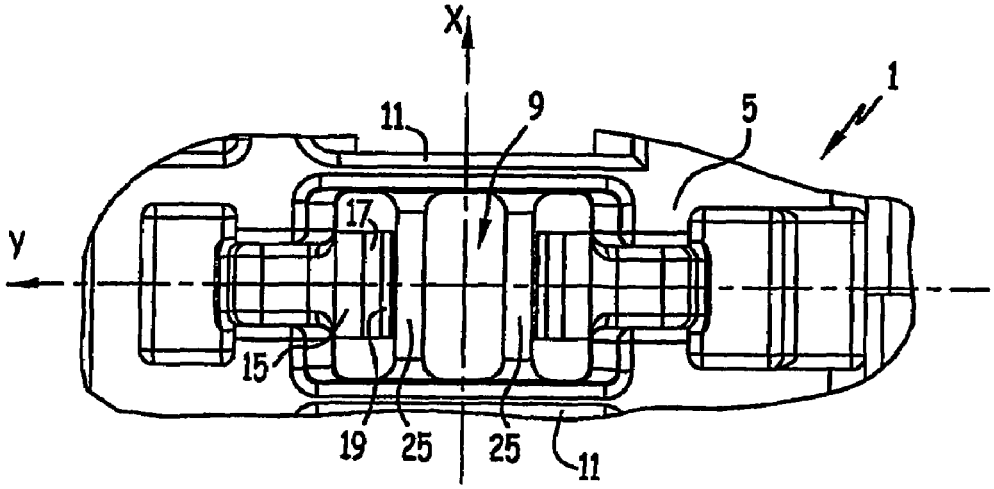

One particular embodiment of the invention will now be described in more detail, in reference to the attached drawings, in which:

- FIG. 1 is a partial perspective view of an electric connector housing according to the invention, cut along the median axial plane of a row of sockets;
- FIG. 2 is a perspective detail view along another direction, and in larger scale, of the housing shown in FIG. 1, more precisely showing the structure of a socket;
- FIG. 3 is a view analogous to FIG. 2, showing a contact engaged and locked inside the socket;
- FIG. 4 is a sectional view, in its median plane, of the socket shown in FIG. 3, and of a contact lodged in this socket; and
- FIG. 5 is a partial view, along direction V of FIG. 2, of the front face of the housing, showing the socket without contact.

In the Figures, an electric connector housing 1 is partially shown, of the type provided to receive and assure the attachment of a plurality of contacts 2 (FIGS. 3 and 4), female contacts here. The choice was made to describe the invention for a housing designed to receive female contacts, but the invention naturally applies in the same way to a housing provided for male contacts.

This housing 1 is formed by molding an insulating material, preferably plastic.

Such a housing, indifferently for the present invention, may constitute a module designed to be lodged in a principal connector housing, or may by itself constitute a principal connector housing, endowed with locking means permitting it to be coupled with a connector counterpart.

In the embodiment shown, housing 1 is present in the general form of a parallelepiped having peripheral outer walls 3, a front face 5 provided to be turned in the direction of coupling with the connector counterpart, and a rear face 7 for introduction of the contacts into the housing.

In the example shown, the housing has, on the side of its rear face 7, a skirt 8 formed by an extension of peripheral outer walls 3. A wire grommet joint (or "grommet"), or a sealing material, for example, can be placed in this skirt 8.

For purposes of clarity of the description which follows, the Figures will be orientated along the system of X, Y, Z axes, in which:

- the Z axis corresponds to the axis of insertion of contacts in housing 1, as well as the axis for coupling connector parts. The Z axis is oriented from back to front, i.e., along the direction of engagement of a contact in the housing and of housing 1 with the connector counterpart; and
- The X axis and the Y axis are the axes "orthogonal" to the Z axis, each of which defines, with the Z axis, a respective plane of outer walls 3.

Throughout the following, the term "axial" will mean a direction parallel to the Z axis, while the directions of the X axis and the Y axis will be respectively called "transverse" and "lateral".

Housing 1 has a series of sockets 9 arranged in several rows that extend laterally.

In the present description, a socket will be defined as an assembly made up of a recess provided to receive a contact, and associated means, part of housing 1, for locking the contact in place in this recess.

Each socket 9 is partially formed as an "axial" channel opening up on front face 5 on one side, and rear face 7 on the other side.

A socket 9 is defined laterally by two parallel lateral walls 11 which extend over the essential part of its length, and transversely, by two parallel opposite transverse walls 13 that extend over an intermediate axial section.

Each socket 9 is provided with two elastic latches 15 that each extend axially from a respective transverse wall 13. Each latch 15, on the side of its free end 17 turned toward the front, has a hook piece 19 turned towards the inside of the socket.

Latches 15 are provided to lock a contact inside its recess, by elastic interlocking, hook piece 19 engaging in a corresponding opening 21 of contact 2.

At the level of front face 5, housing 1 is molded, for each socket 9, with two bars 25 parallel to the X axis connecting the two opposite lateral walls 11 of the socket.

In this embodiment, bars 25 connecting consecutive lateral walls 11 procure an increased rigidity for the front face of the housing with a small input of material.

In an alternative embodiment, at least one of the bars could be interrupted, or made up of two facing contact studs, each joined to one respective wall 11 and projecting towards the socket axis. Thus, introducing the contact into the socket and putting a test point under pressure would be facilitated.

The two bars 25 of the same socket are spaced laterally at a distance permitting the introduction of a latch or of a contact terminal complementary to the female contact 2. In the case of a housing containing male contacts, the bars are spaced at a distance permitting the passage of a free-end part, strip or terminal, of the contact.

As can be seen in FIGS. 3 and 4, in which is shown a contact 2 lodged and locked in a socket 9, bars 25 are provided to form stops limiting the insertion of contact 2 in socket 9. For this purpose, bars 25 are separated axially from hook pieces 19 for a distance roughly corresponding to the distance separating the front end of contact 2 from opening 21.

It is understood, in view of FIGS. 3 and 4, that latches 15 permit locking a contact 2 in socket 9 in its operating position, by opposing the withdrawal of the contact towards the rear of the housing, and that bars 25 oppose the extraction of the contact through the front from its locked position in the socket. This function is assured by the front end of the contact being stopped on bars 25.

According to the preceding, socket 9 is therefore provided with means for locking the contact by an elastic interlocking, made up of latches 15, and stop means limiting the insertion of the contact, made up of two parallel bars 25.

In FIGS. 1 to 5, it can also be seen that each socket 9, including latches 15 and bars 25, is symmetrical with regard to its median transverse plane XZ, and with regard to its median lateral plane YZ.

In FIG. 5 it can be more particularly seen that each bar is formed over a section, along the Y axis, adjacent to but not overlapping with regard to the section on which latch 15 is formed, situated on the same side of the transverse plane of symmetry. In other words, the projection along the Z axis over plane XY of the two bars 25 is situated between the projections of the two latches 15 on the same plane, without overlapping or interference of the projections of the bars, on the one hand, with the projections of the latches, on the other hand.

Thus, during the manufacturing of the housing by molding, latches 15 and bars 25 can be formed by means of pins with axial movement Z, without necessitating the use of slides with lateral or transverse movement.

On the other hand, the molding of such bars 25 does not involve additional constraints on the width (along the X axis) of latches 15. These latches can therefore be formed with a width more or less equal to the width of socket 9, defined as the distance separating the two lateral walls 11. For example, the width of latch 15 can advantageously be greater than 0.8 times the width of the socket.

This characteristic is more particularly visible in FIG. 2, for the socket next to the one containing the plane of section. It is noted that, for the socket containing the plane of section, each latch is shown with a width equal to half the width of the complete latch, such as it appears in the neighboring socket.

Although this has not been shown, latch 15 can be provided with a maximum width on the side of its rear end, by which it is connected to respective wall 13, its width being able to progressively decrease from the rear end to the free front end 17.

The increase in the width of a latch when compared to the width of the latches such as they are designed in the prior art, and particularly the increase in the width of the side of the part connecting with wall 13, which is rendered possible by the presence of bars 25, permits increasing the force of retention in the socket exerted by the latch on contact 2.

This improvement of locking performance of the contact inside housing 1 is realized without generating additional complexity for molding the housing.

The invention claimed is:

1. An electric connector housing, which comprises an assembly of sockets each provided to receive a contact by engaging along a (Z) axis, each socket of the assembly being at least partially defined by at least two opposite axial lateral walls, and comprising two locking elastic latches extending generally axially from two respective opposite transverse walls, characterized in that each socket comprises, on the side of its front end, at least one bar forming a stop for limiting the insertion of the contact in the socket, which is formed so that its axial projection is situated between latches and does not interfere with the latches.

2. The electric connector housing which comprises an assembly of sockets each provided to receive a contact by engaging along a (Z) axis, each socket of the assembly being at least partially defined by at least two opposite axial lateral walls, and comprising two locking elastic latches extending generally axially from two respective opposite transverse walls, characterized in that each socket comprises, on the side of its front end, at least one bar forming a stop for limiting the insertion of the contact in the socket, which is formed so that its axial projection is situated between latches and does not interfere with the latches, further characterized in that said bar connects the two opposite lateral walls adjacent to transverse walls.

3. The electric connector housing according to claim 1, further characterized in that each socket of the assembly is provided with two such bars forming stops, which extend parallelly.

4. The electric connector housing according to claim 1, further characterized in that over at least one axial section, at least one of the two latches has a width about equal to the width of socket.

5. The electric connector housing according to claim 1, further characterized in that at least one of the two latches is connected to respective transverse wall by its rear end, comprises a hook piece which projects towards the (Z) axis of socket from its front end side which is free, and has a maximum width on the side of its rear end.

6. The electric connector housing according to claim 1, further characterized in that each socket of the assembly is symmetrical relative to an axial plane (XZ) extending between the two latches.

7. The electric connector housing according to claim 1, further characterized in that it is molded of one plastic piece.

8. The electric connector comprising a housing according to claim 1, and contacts engaged in the respective sockets of said housing.

9. An electrical connector housing comprising a plurality of sockets, wherein each socket is adapted to receive a contact by engaging along a (Z) axis, wherein each socket is at least partially defined by two opposite axial lateral walls, and wherein the housing further comprises two locking elastic latches at each socket extending generally axially from two respective opposite transverse walls, wherein each socket comprises, on a front end, at least one bar forming a stop for limiting insertion of the contact into the socket, wherein the at least one bar is formed having an axial projection situated in an area generally between the latches which is forwardly spaced from ends of the latches and which does not interfere with the latches.

10. The electric connector housing according to claim 9 further characterized in that the bar connects the two opposite lateral walls adjacent to transverse walls.

* * * * *